US008539888B2

(12) United States Patent
Hernandez et al.

(10) Patent No.: US 8,539,888 B2
(45) Date of Patent: Sep. 24, 2013

(54) TABLE-BOARD-PARTITION

(75) Inventors: Noe Vargas Hernandez, El Paso, TX (US); Jose Gabriel Davila Rangel, Ft. Wayne, IN (US); Angel Ernesto Delgado, Arlington, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 13/416,670

(22) Filed: Mar. 9, 2012

(65) Prior Publication Data

US 2012/0255465 A1 Oct. 11, 2012

Related U.S. Application Data

(60) Provisional application No. 61/452,003, filed on Mar. 11, 2011.

(51) Int. Cl.
*A47B 3/00* (2006.01)

(52) U.S. Cl.
USPC ..... 108/115

(58) Field of Classification Search
USPC ..... 108/115, 1, 5, 6, 7, 8, 9, 10, 144.11, 108/147
See application file for complete search history.

(56) References Cited

U.S. PATENT DOCUMENTS

| | | | | |
|---|---|---|---|---|
| 456,990 | A * | 8/1891 | Hawley | 108/10 |
| 2,775,497 | A * | 12/1956 | Alvarez | 108/8 |
| 3,140,559 | A * | 7/1964 | Grow et al. | 108/6 |
| 3,641,946 | A * | 2/1972 | Charnay | 108/6 |
| 4,099,469 | A * | 7/1978 | Sahli | 108/1 |
| 5,313,892 | A | 5/1994 | Tice | |
| 7,614,351 | B2 * | 11/2009 | Piretti | 108/115 |
| 7,836,833 | B2 * | 11/2010 | Kumazawa | 108/115 |
| 8,051,785 | B2 * | 11/2011 | Lin | 108/115 |
| 8,272,336 | B2 * | 9/2012 | Rutz | 108/115 |
| 2004/0123780 | A1 | 7/2004 | Butts, Jr. | |
| 2009/0283021 | A1 * | 11/2009 | Wong | 108/116 |
| 2011/0017107 | A1 * | 1/2011 | Ko | 108/64 |
| 2011/0139042 | A1 * | 6/2011 | Korb | 108/115 |
| 2011/0290159 | A1 * | 12/2011 | Saito | 108/115 |

* cited by examiner

*Primary Examiner* — Jose V Chen
(74) *Attorney, Agent, or Firm* — Edwin S. Flores; Chainey P. Singleton; Chalker Flores, LLP

(57) ABSTRACT

A transforming project table, white erase board, and office partition all-in-one powered by a drive system is disclosed herein.

37 Claims, 5 Drawing Sheets

TABLE-BOARD-PARTITION

CROSS-REFERENCE TO RELATED APPLICATIONS

This application claims priority based on U.S. Provisional Application No. 61/452,003, filed Mar. 11, 2011. The contents of each of which is incorporated by reference in their entirety.

TECHNICAL FIELD OF THE INVENTION

The present invention relates in general to the field of office furniture, and more specifically to a transforming project table, white erase board, and office partition all-in-one powered by, e.g., a pneumatic, spring, electric or hydraulic system.

STATEMENT OF FEDERALLY FUNDED RESEARCH

None.

INCORPORATION-BY-REFERENCE OF MATERIALS FILED ON COMPACT DISC

None.

REFERENCE TO A SEQUENCE LISTING

None.

BACKGROUND OF THE INVENTION

Without limiting the scope of the invention, its background is described in connection with office furniture designs.

U.S. Pat. No. 5,313,892 issued to Tice (1994) describes a pneumatic table that adjusts to various positions. Pneumatic cylinders controlled by a pneumatic system raise and lower the tabletop to a desired position. Brakes are used to lock the tabletop once it is in its desired position. The tabletop tilts forward and backward to vary the operating position of a piece of machinery located on the tabletop. A self-adjusting foot treadle adjusts when the tabletop height is changed such that the linkage between the treadle and the tabletop is maintained. The treadle also adjusts to various positions for the comfort of the operator.

U.S. Patent Application No. 20040123780 (Kenneth, 2002) describes a portable and expandable project plan table that includes a table top that is pivotally connected to a frame having a generally truncated right triangular prism shape. The table top is hinged to permit access to storage for drafting tools and papers within the frame and may be locked to prevent movement when the table is transported. The legs of the table pivot between vertical for use and horizontal for transporting, and are designed to overlap in the folded position in a compact arrangement. Each leg is independently height adjustable to permit the table to be made level on uneven surfaces, and wheels on each leg facilitate movement of the table in the open-for-use position. The table is constructed of durable materials to permit use out of doors or in adverse conditions.

SUMMARY OF THE INVENTION

The present invention describes a transforming project table, white erase board, and office partition all-in-one powered by a pneumatic system.

The present invention in one embodiment describes an adjustable work surface capable of movement along a vertical axis, capable of a 360-degree rotation around a pivot or both comprising: (i) a generally planar tabletop defining a plane, wherein the table top comprises a work (top) surface, a bottom surface, a front edge, a back edge, a left edge, and a right edge, (ii) a generally vertical support member disposed for a movement in a generally vertical direction, wherein a top portion of the vertical support member is attached to the right edge and the left edge of the tabletop by one or more pivot joints, wherein the vertical support member further comprises one or more supporting bars extending along a length of the support member and attached to a bottom portion of the support member, wherein the bars are substantially parallel to each other and are capable of movement along the vertical direction concomitantly with a vertical movement of the support member, (iii) a drive system or mechanism for moving the vertical support member in the vertical direction, (iv) a generally vertical frame structure for receiving the vertical support member, and (v) two or more wheels for ease of movement of the work surface, wherein the wheel are attached directly to the frame structure or may be attached to a rod or a similar device welded onto or attached to the frame structure. The frame structure of the adjustable work surface of the present invention further comprises: a) a first stationary support bar attached to a top portion of the frame structure and extending along the length of the frame structure, wherein the bar comprises a ridge or a groove for receiving the front edge or the back edge of the planar tabletop, wherein the bar is substantially parallel to the one or more bars of the support member, wherein the bar is parallel to the tabletop when the tabletop is horizontal at a 0° angle and is perpendicular to the tabletop when the tabletop is vertical at a 90° angle and b) a second stationary support bar attached to a bottom portion of the frame structure, wherein the bar is substantially parallel to the first stationary support bar and to the one or more bars of the support member.

In one aspect tabletop comprises a white board, an easel, a project table, a partition board, or combinations and modifications thereof. In another aspect the first stationary support bar is a top edge of a planar surface, wherein the planar surface enables functioning of the work surface as a partition and comprises a material similar to the planar tabletop. In another aspect the ridge or the groove in the first stationary support bar locks the tabletop at a 90° angle. In yet another aspect the adjustable work surface further comprises a wheel locking mechanism for preventing movement of the work surface during use and a mechanism for removing the wheels once the work surface is placed at a desired location. In related aspects the work surface is used as a project table when the tabletop is substantially horizontal or at a 0° angle and is used as white board or an easel when the tabletop is adjusted at an angle between 45° and 90°. In another aspect the work surface is used as a partitioning device or partition board when the work surface is substantially vertical or at a 90° angle. In another aspect the drive system is a pneumatic, spring, electric or hydraulic drive system.

Another embodiment of the present invention discloses a transforming all-in-one powered system comprising a project table, a white erase board, and an office partition device capable of movement along a vertical axis, capable of a 360-degree rotation around a pivot or both comprising:

(i) a generally planar tabletop defining a plane, wherein the table top comprises a work (top) surface, a bottom surface, a front edge, a back edge, a left edge, and a right edge, (ii) a generally vertical support member disposed for a movement in a generally vertical direction, wherein a top portion of the vertical support member is attached to the right edge and the left edge of the tabletop by one or more pivot joints, wherein the vertical support member further comprises one or more supporting bars extending along a length of the support member and attached to a bottom portion of the support member, wherein the bars are substantially parallel to each other and are capable of movement along the vertical direction concomitantly with a vertical movement of the support member, (iii) a drive system or mechanism for moving the vertical support member in the vertical direction, (iv) a generally vertical frame structure for receiving the vertical support member, wherein the frame structure further comprises: a) a first stationary support bar attached to a top portion of the frame structure and extending along the length of the frame structure, wherein the bar comprises a ridge or a groove for receiving the front edge or the back edge of the planar tabletop, wherein the bar is substantially parallel to the one or more bars of the support member, wherein the bar is parallel to the tabletop when the tabletop is horizontal at a 0° angle and is perpendicular to the tabletop when the tabletop is vertical at a 90° angle and a second stationary support bar attached to a bottom portion of the frame structure, wherein the bar is substantially parallel to the first stationary support bar and to the one or more bars of the support member, and (v) two or more wheels for ease of movement of the work surface, wherein the wheel are attached directly to the frame structure or may be attached to a rod or a similar device welded onto or attached to the frame structure.

In one aspect of transforming system of the present invention the ridge or the groove in the first stationary support bar locks the tabletop at a 90° angle. In another aspect the first stationary support bar is a top edge of a planar surface. In yet another aspect the planar surface enables functioning of the system surface as a partition and comprises a material similar to the planar tabletop. In another aspect the system further comprises a wheel locking mechanism for preventing movement of the system during use. In a specific aspect the system is used as a project table when the tabletop is substantially horizontal or at a 0° angle. In related aspects the system is used as white board or an easel when the tabletop is adjusted at an angle between 45° and 90° or as a partitioning device or partition board when the work surface is substantially vertical or at a 90° angle. In yet another aspect the drive system is a pneumatic, spring, electric or hydraulic drive system.

In yet another embodiment the instant invention provides a method of transforming an open space, dividing a large area into one or more smaller areas or both comprising the steps of: providing an open space, a large area or both, providing one or more drive operated partitioning devices capable of movement along a vertical axis, capable of a 360-degree rotation around a pivot or both comprising: (a) a generally planar tabletop defining a plane, wherein the table top comprises a work (top) surface, a bottom surface, a front edge, a back edge, a left edge, and a right edge, (b) a generally vertical support member disposed for a movement in a generally vertical direction, wherein a top portion of the vertical support member is attached to the right edge and the left edge of the tabletop by one or more pivot joints, wherein the vertical support member further comprises one or more supporting bars extending along a length of the support member and attached to a bottom portion of the support member, wherein the bars are substantially parallel to each other and are capable of movement along the vertical direction concomitantly with a vertical movement of the support member, (c) a drive system or mechanism for moving the vertical support member in the vertical direction, (d) a generally vertical frame structure for receiving the vertical support member, wherein the frame structure further comprises: (i) a first stationary support bar attached to a top portion of the frame structure and extending along the length of the frame structure, wherein the bar comprises a ridge or a groove for receiving the front edge or the back edge of the planar tabletop, wherein the bar is substantially parallel to the one or more bars of the support member, wherein the bar is parallel to the tabletop when the tabletop is horizontal at a 0° angle and is perpendicular to the tabletop when the tabletop is vertical at a 90° angle and (ii) a second stationary support bar attached to a bottom portion of the frame structure, wherein the bar is substantially parallel to the first stationary support bar and to the one or more bars of the support member, and (e) two or more wheels for ease of movement of the work surface, wherein the wheel are attached directly to the frame structure or may be attached to a rod or a similar device welded onto or attached to the frame structure, and placing the one or more partitioning devices with the planar tabletop in a vertical orientation in the open space or the large area to transform or divide the open space or the large area, wherein the one or more partitioning devices may be linked to each other or to existing structures in the open space or the large area by one or more connectors.

In one aspect of the method disclosed hereinabove the open space or the large area comprises an office space, a laboratory, a warehouse, a classroom, a conference room, an arena and any combinations thereof. In another aspect the partitioning device transforms an office space into one or more cubicles, training rooms, conference rooms, and any combinations thereof. In yet another aspect the connectors comprise ropes, chains, tethers, and any combinations thereof. In another aspect the method further comprises a wheel locking mechanism for preventing movement of the partitioning device.

In one aspect the ridge or the groove in the first stationary support bar locks the tabletop at a 90° angle. In another aspect the first stationary support bar is a top edge of a planar surface. In yet another aspect the planar surface enables functioning of the partitioning device to transform the open space, divide the large area into one or more smaller areas or both. In a related aspect the planar surface comprises a material similar to the planar tabletop. In another aspect the tabletop comprises a white board, an easel, a project table, a partition board, or combinations and modifications thereof. In yet another aspect the partitioning device may be used as the project table, the white board, or the easel in the open space or the large area. In related aspects of the method the partitioning device is used as a project table when the tabletop is substantially horizontal or at a 0° angle and the partitioning device is used as white board or an easel when the tabletop is adjusted at an angle between 45° and 90°. In another aspect the drive system is a pneumatic, spring, electric or hydraulic drive system.

The present invention in one aspect describes an office space or a large area transformed or partitioned into one or more small areas or cubicles by the method disclosed herein. In another aspect.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

The instant invention relates to a transforming project table, white erase board, and office partition all-in-one powered by a pneumatic system.

Figure 1:
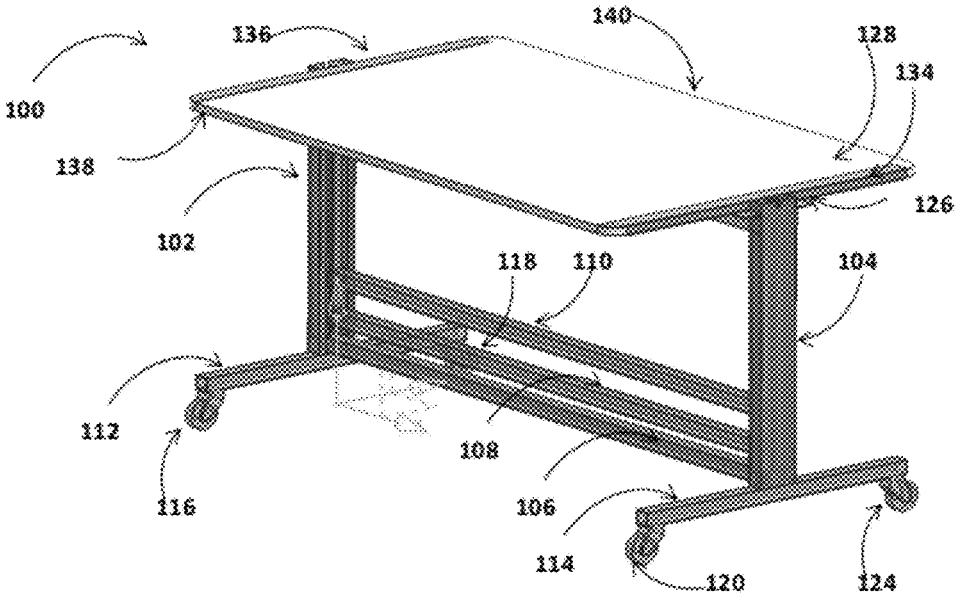
FIG. 1 is a schematic of the table-board-partition of the present invention with the tabletop substantially horizontal or at a 0° angle for use as a project board.
Figure 5:
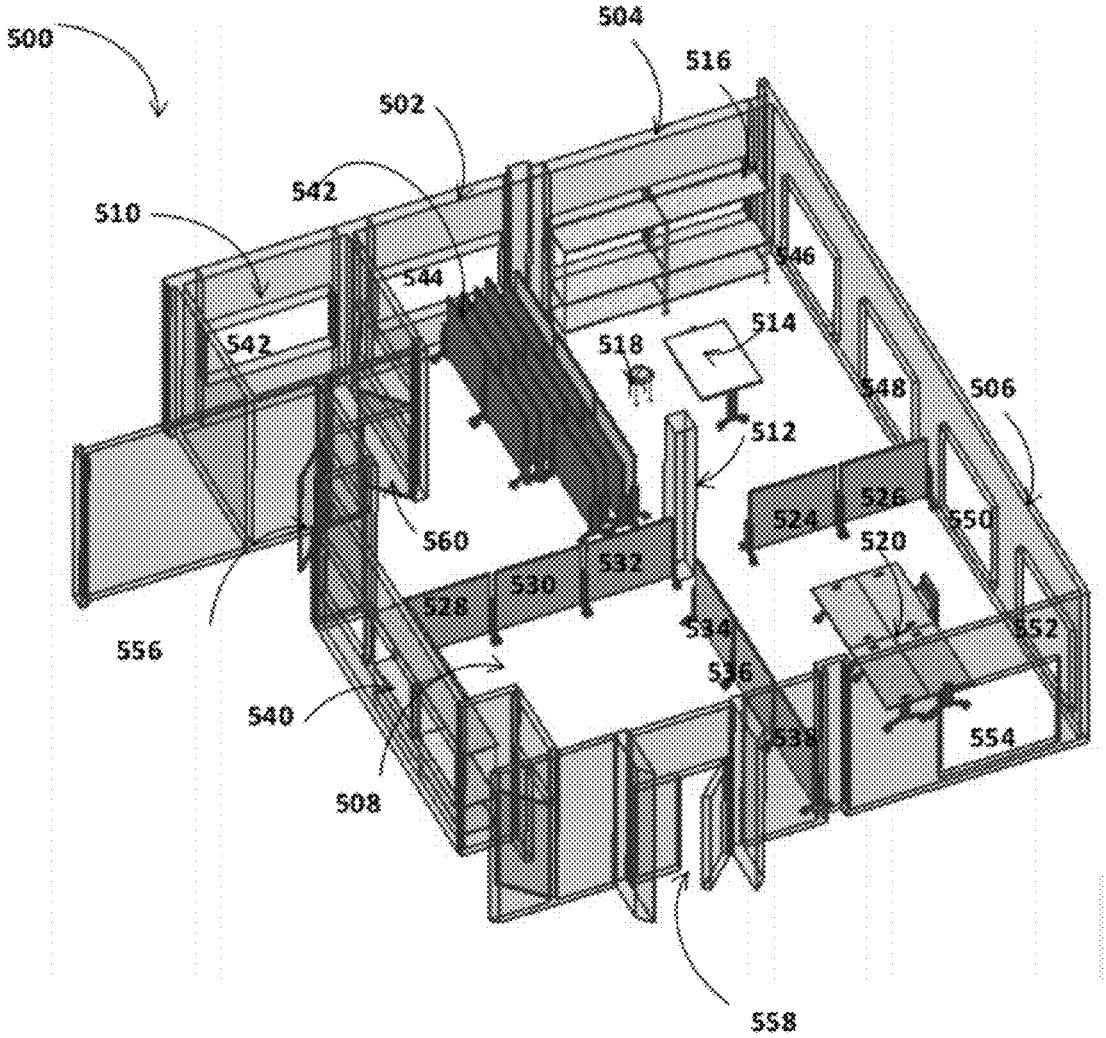
FIG. 5 is a representation of a large office space divided into one or more smaller areas using the table-board-partition of the present invention.

FIG. 1 is a schematic of the table-board-partition 100 of the present invention. The table-board-partition comprises a generally planar tabletop defining a plane, wherein the table top comprises a work (top) surface 128, a bottom surface (not shown), a front edge 138, a back edge 140, a left edge 136, and a right edge 134. A generally vertical support member disposed for a movement in a generally vertical direction, wherein a top portion of the vertical support member is attached to the right edge 134 and the left edge 136 of the tabletop by one or more pivot joints (not shown), wherein the vertical support member further comprises one or more supporting bars 108 and 110 extending along a length of the support member and attached to a bottom portion of the support member, wherein the bars are substantially parallel to each other and are capable of movement along the vertical direction concomitantly with a vertical movement of the support member. A pneumatic drive system or mechanism moves the vertical support member in the vertical direction. A generally vertical frame structure 102 and 104 for receiving the vertical support member, wherein the frame structure further comprises: (i) a first stationary support bar 126 attached to a top portion of the frame structure and extending along the length of the frame structure, wherein the bar comprises a ridge or a groove for receiving the front edge or the back edge of the planar tabletop, wherein the bar is substantially parallel to the one or more bars 108 and 110 of the support member, wherein the bar is parallel to the tabletop when the tabletop is horizontal at a 0° angle and is perpendicular to the tabletop when the tabletop is vertical at a 90° angle and (ii) a second stationary support bar 106 attached to a bottom portion of the frame structure, wherein the bar is substantially parallel to the first stationary support bar 126 and to the one or more bars (108 and 110) of the support member. The table-board-partition 100 further comprises four wheels (116, 118, 120 and 124) for ease of movement of the work surface, wherein the wheel are attached directly to the frame structure or may be attached to a rod (112 and 114) or a similar device welded onto or attached to the frame structure 102 and 104. The tabletop 128 of the system 100 is substantially horizontal or at a 0° angle for use as a project board. In order for the table-board-partition 100 to function as a partition the area below the table delineated by components 102, 104, 106 on both sides comprises a planar surface made of a material that is the same or similar to the table top material (surface). These two surfaces (on both sides) of the planar surface are not drawn or shown on in FIG. 1 in order to show the internal components. The first stationary support bar 126 is a top edge of the planar surface (not shown). The planar surface enables functioning of the work surface as a partition. The use of system 100 as a partition board is shown in FIG. 5 (for e.g. 524).

Figure 2:
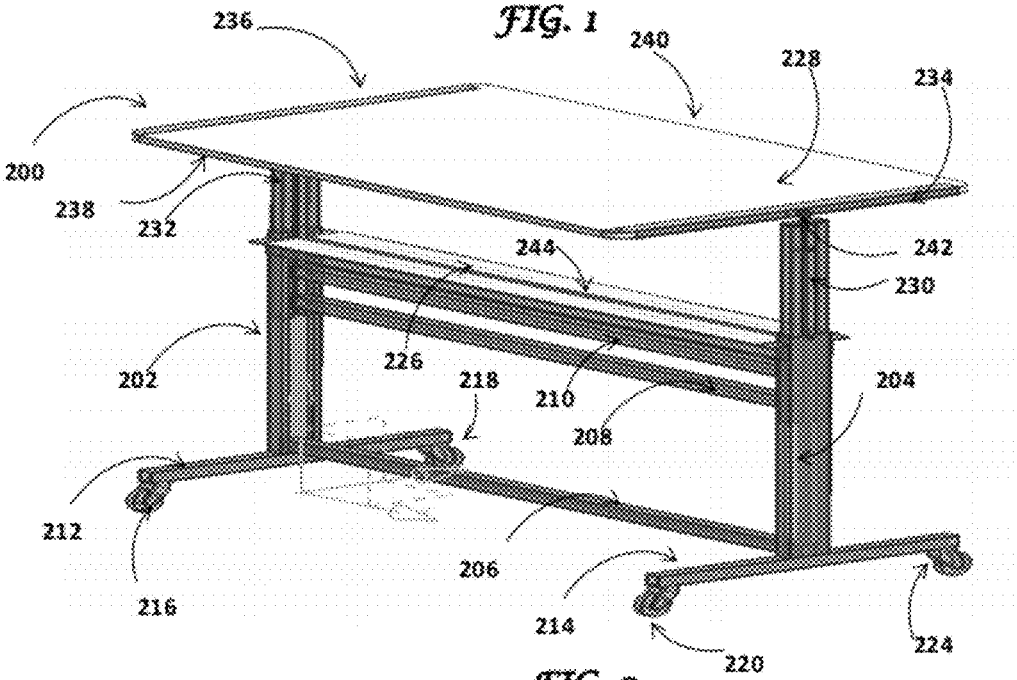
FIG. 2 is a schematic of the table-board-partition of the present invention with the tabletop pneumatically raised and substantially horizontal or at a 0° angle for use as a project board.

FIG. 2 is a schematic of the table-board-partition 200 of the present invention comprising a generally planar tabletop defining a plane, wherein the table top comprises a work (top) surface 228, a bottom surface (not shown), a front edge 238, a back edge 240, a left edge 236, and a right edge 234. A generally vertical support member (230 and 232) is disposed for a movement in a generally vertical direction, wherein a top portion of the vertical support member 230 is attached to the right edge 234 by a pivot joint 242 (only one joint is shown herein), wherein the vertical support member further comprises one or more supporting bars 208 and 210 extending along a length of the support member and attached to a bottom portion of the support member, wherein the bars are substantially parallel to each other and are capable of movement along the vertical direction concomitantly with a vertical movement of the support member. A pneumatic drive system or mechanism moves the vertical support member 230 and 232 in the vertical direction. A generally vertical frame structure 202 and 204 receives the vertical support member 232 and 230, respectively wherein the frame structure 202 and 204 further comprises: (i) a first stationary support bar 226 attached to a top portion of the frame structure and extending along the length of the frame structure, wherein the bar comprises a ridge or a groove 244 for receiving the front edge or the back edge of the planar tabletop, wherein the bar is substantially parallel to the one or more bars 208 and 210 of the support member, wherein the bar 226 is parallel to the tabletop when the tabletop is horizontal at a 0° angle and is perpendicular to the tabletop when the tabletop is vertical at a 90° angle and (ii) a second stationary support bar 206 attached to a bottom portion of the frame structure, wherein the bar is substantially parallel to the first stationary support bar 226 and to the one or more bars (208 and 210) of the support member. The table-board-partition 200 further comprises four wheels (216, 218, 220 and 224) for ease of movement of the work surface, wherein the wheel are attached directly to the frame structure or may be attached to a rod (212 and 214) or a similar device welded onto or attached to the frame structure 204 and 202. The tabletop 228 of the system 200 is pneumatically raised and is substantially horizontal or at a 0° angle for use as a project board.

Figure 3:
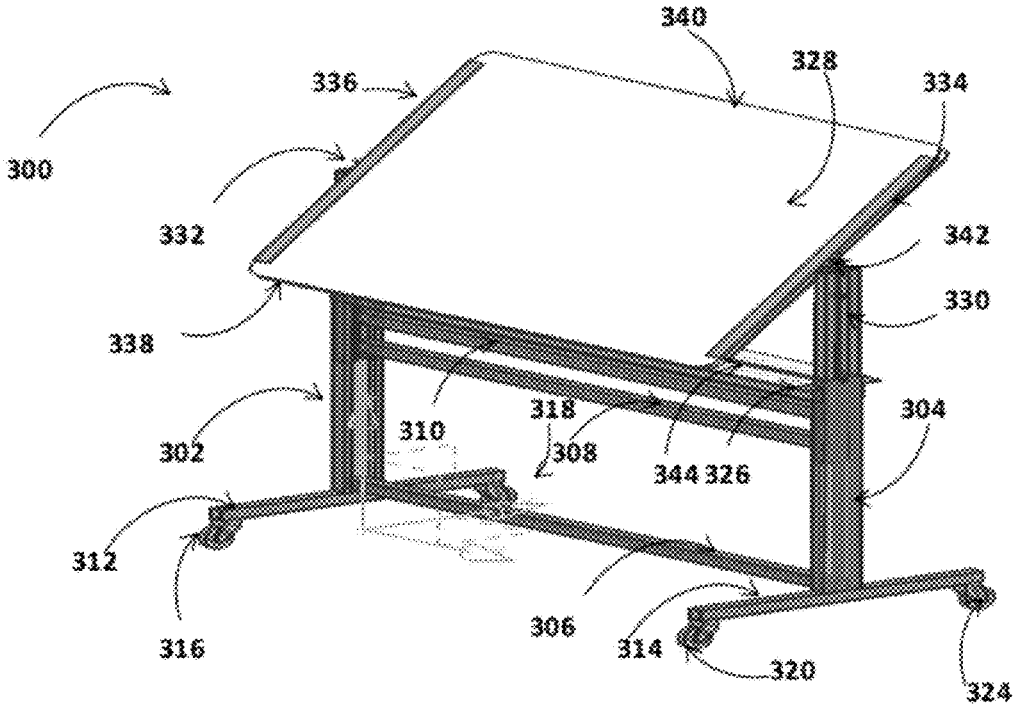
FIG. 3 is a schematic of the table-board-partition of the present invention with the tabletop pneumatically raised and adjusted at an angle for use as a white board or an easel.

FIG. 3 is a schematic of the table-board-partition 300 of the present invention comprising a generally planar tabletop defining a plane, wherein the table top comprises a work (top) surface 328, a bottom surface (not shown), a front edge 338, a back edge 340, a left edge 336, and a right edge 234. A generally vertical support member (330 and 332) is disposed for a movement in a generally vertical direction, wherein a top portion of the vertical support member 330 is attached to the right edge 334 by a pivot joint 342 (only one joint is shown herein), wherein the vertical support member further comprises one or more supporting bars 308 and 310 extending along a length of the support member and attached to a bottom portion of the support member, wherein the bars are substantially parallel to each other and are capable of movement along the vertical direction concomitantly with a vertical movement of the support member. A pneumatic drive system or mechanism moves the vertical support member 330 and 332 in the vertical direction. A generally vertical frame structure 302 and 304 receives the vertical support member 332 and 330, respectively wherein the frame structure 302 and 304 further comprises: (i) a first stationary support bar 326 attached to a top portion of the frame structure and extending along the length of the frame structure, wherein the bar comprises a ridge or a groove 344 for receiving the front edge or the back edge of the planar tabletop, wherein the bar is substantially parallel to the one or more bars 308 and 310 of the support member, wherein the bar 326 is parallel to the tabletop when the tabletop is horizontal at a 0° angle and is perpendicular to the tabletop when the tabletop is vertical at a 90° angle and (ii) a second stationary support bar 306 attached to a bottom portion of the frame structure, wherein the bar is substantially parallel to the first stationary support bar 326 and to the one or more bars (308 and 310) of the support member. The table-board-partition 300 further comprises four wheels (316, 318, 320 and 324) for ease of movement of the work surface, wherein the wheel are attached directly to the frame structure or may be attached to a rod (312 and 314) or a similar device welded onto or attached to the frame structure 304 and 302. The tabletop 328 of the system 300 is pneumatically raised and adjusted at an angle for use as a white board or an easel.

Figure 4:
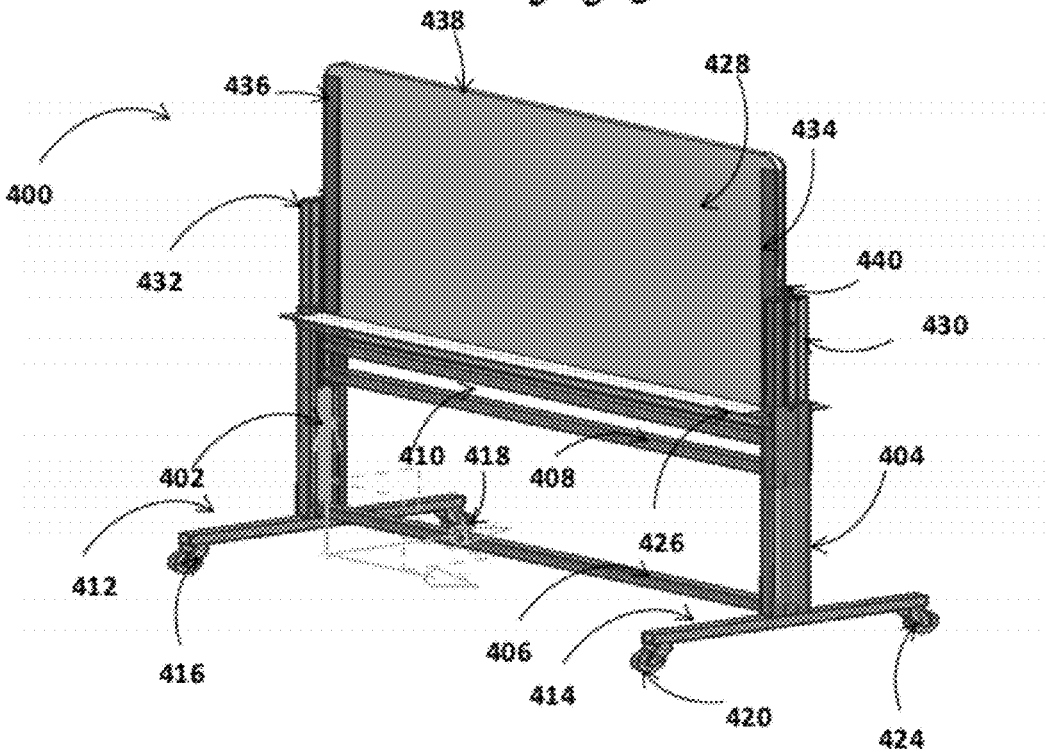
FIG. 4 is a schematic of the table-board-partition of the present invention with the tabletop pneumatically raised and locked at a 90° angle for use as a partition or a whiteboard.

FIG. 4 is a schematic of the table-board-partition 400 of the present invention comprising a generally planar tabletop defining a plane, wherein the table top comprises a work (top) surface 428, a bottom surface (not shown), a front edge (not shown), a back edge 438, a left edge 436, and a right edge 434. A generally vertical support member (430 and 432) is disposed for a movement in a generally vertical direction, wherein a top portion of the vertical support member 430 is attached to the right edge 434 by a pivot joint 440 (only one joint is shown herein), wherein the vertical support member further comprises one or more supporting bars 408 and 410 extending along a length of the support member and attached to a bottom portion of the support member, wherein the bars are substantially parallel to each other and are capable of movement along the vertical direction concomitantly with a vertical movement of the support member. A pneumatic drive system or mechanism moves the vertical support member 430 and 432 in the vertical direction. A generally vertical frame structure 402 and 404 receives the vertical support member 432 and 430, respectively, wherein the frame structure 402 and 404 further comprises: (i) a first stationary support bar 426 attached to a top portion of the frame structure and extending along the length of the frame structure, wherein the bar comprises a ridge or a groove (not shown herein) that receives and locks the front edge of the planar tabletop 428 as shown herein. The bar 426 is substantially parallel to the one or more bars 408 and 410 of the support member, wherein the bar 426 is parallel to the tabletop when the tabletop is horizontal at a 0° angle and is perpendicular to the tabletop when the tabletop is vertical at a 90° angle and (ii) a second stationary support bar 406 attached to a bottom portion of the frame structure, wherein the bar is substantially parallel to the first stationary support bar 426 and to the one or more bars (408 and 410) of the support member. The table-board-partition 400 further comprises four wheels (416, 418, 420 and 424) for ease of movement of the work surface, wherein the wheel are attached directly to the frame structure or may be attached to a rod (412 and 414) or a similar device welded onto or attached to the frame structure 404 and 402. The tabletop 428 of the system 400 is pneumatically raised and locked at a 90° angle for use as a partition or a whiteboard.

FIG. 5 is a representation of a large office space 500 divided into one or more smaller areas using the table-board-partition of the present invention. Office space 500 comprises a cubicle 510 and four smaller areas 502, 504, 506 and 508 that are created using the table-board partition of the present invention. There are two doors 556 and 558 for entry or exit from the office space 500. White boards or glass windows 542, 544, 546, 548, 550, 552 and 554 line the walls of the office space 500. Area 502 is a storage area for the table-board-partitions 542 for use in this and other areas of the office space. The area also has a door 560 for entry and exit into cubicle 510. Area 502 is separated from area 508 by using the partition boards 528, 530, and 532. Rea 508 also comprises a shelf 540 and is separated from area 506 by use of three partition boards 534, 536, and 538. Areas 506 is designed to be a conference room and has a conference table 520 and is separated from area 504 by using boards 524 and 526. Area 504 is a project room which comprises a project table 514 and a stool 518 and shelf 516. Area 504 is separated from area 502. Office space 500 has a central pillar designated as 512.

Figure 6:
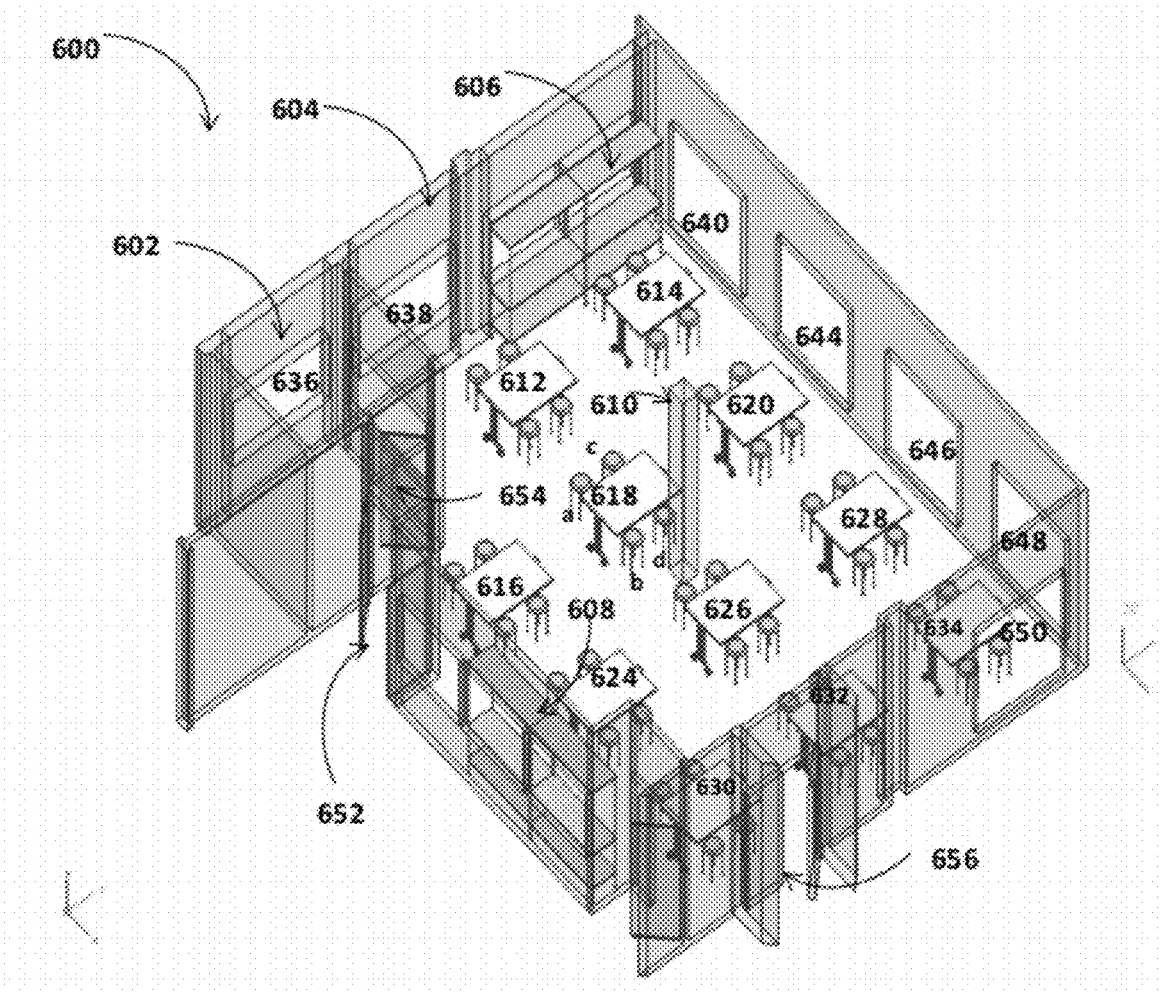
FIG. 6 is a representation of a large office space with multiple project tables comprising the table-board-partition of the present invention.

FIG. 6 is a representation of a large office space 600 with multiple project tables comprising the table-board-partition of the present invention. Office space 600 has a cubicle 602 and a large area 604 comprising multiple project tables comprising the partition-table-board of the present invention. These are designated as 612, 614, 616, 618, 618, 620, 624, 626, 628, 630, 632, and 634. Each project table can seat up to four people and work stools are provided for this purpose (designated as a, b, c, and d for only project table 618 herein). There are two doors 656 and 658 for entry or exit from the office space 600 and a door 654 for entry and exit from cubicle 602 to the area 604. There are two shelves 606 and 608 placed in the area 604. White boards or glass windows 636, 638, 640, 644, 646, 648, and 650 line the walls of the office space 600. Office space 600 has a central pillar designated as 610.

Figure 7:
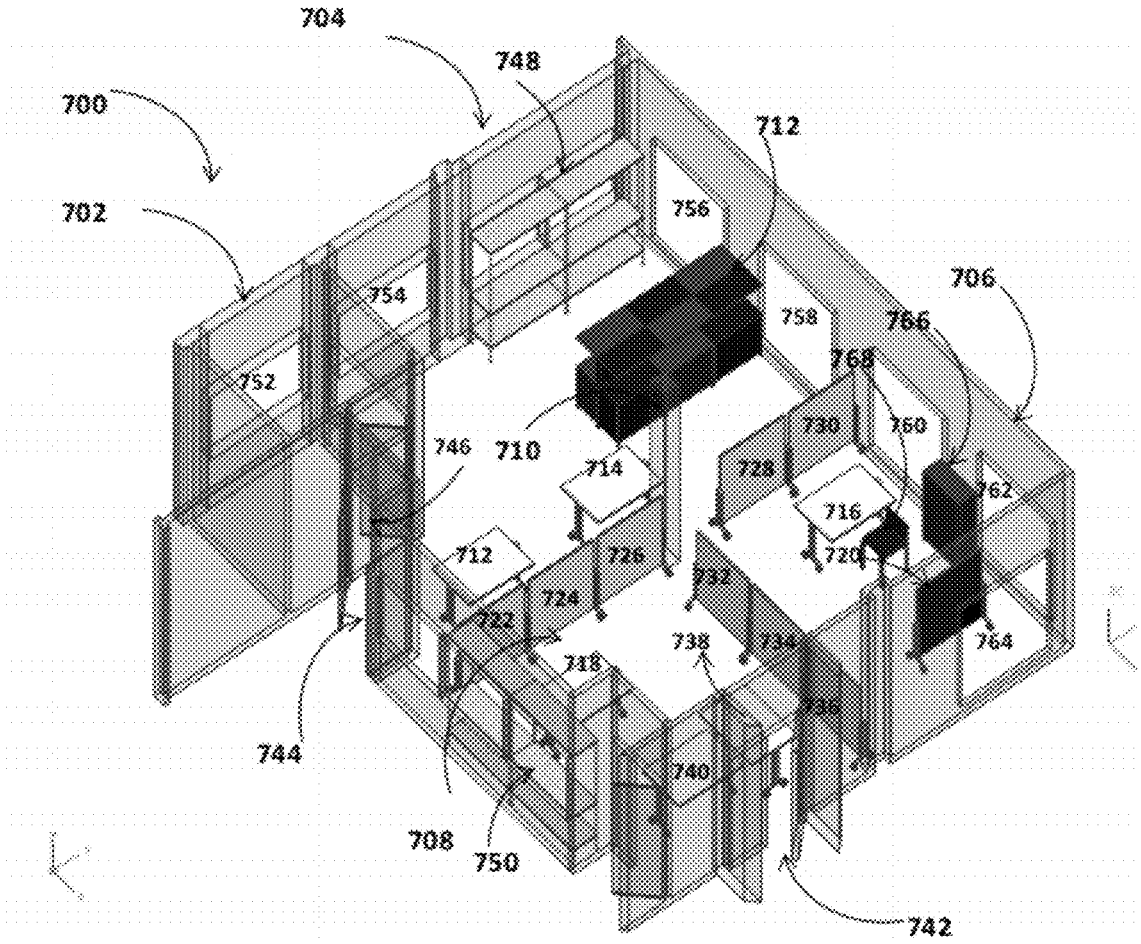
FIG. 7 is a representation of a large office space divided into one or more smaller areas using the table-board-partition of the present invention. One or more project tables comprising the table-board-partition of the present invention are contained with the smaller areas.

FIG. 7 is a representation of a large office space 700 divided into one or more smaller areas using the table-board-partition of the present invention. One or more project tables comprising the table-board-partition of the present invention are contained with the smaller areas. Office space 700 comprises a cubicle 702 and three areas one large 704, and two smaller areas 706 and 708 that are created using the table-board partition of the present invention. There are two doors 742 and 744 for entry or exit from the office space 700. White boards or glass windows 752, 754, 756, 758, 760, 762, and 764 line the walls of the office space 700. The area also has a door 746 for entry and exit into cubicle 702 from areas 704. Area 704 is separated from areas 706 and 708 by using partition boards 528, 530, and 722, 724, and 726, respectively arranges on either sides of the central pillar 710. Area 704 comprises a shelf 748 and a work station 712 and two project tables 712 and 714. Area 706 comprises a project table 716, a chair 720, a cabinet 762, and a white board 764. Area 708 comprises three project tables (718, 738, and 740) and a shelf 750.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

REFERENCES

U.S. Pat. No. 5,313,892: Table with Height and Tilt Adjust.

U.S. Patent Application No. 20040123780: Portable Expandable Project Table.

What is claimed is:

1. An adjustable work surface capable of movement along a vertical axis, capable of a 360-degree rotation around a pivot or both comprising:

a generally planar tabletop defining a plane, wherein the table top comprises a work (top) surface, a bottom surface, a front edge, a back edge, a left edge, and a right edge;

a generally vertical support member disposed for a movement in a generally vertical direction, wherein a top portion of the vertical support member is attached to the right edge and the left edge of the tabletop by one or more pivot joints, wherein the vertical support member further comprises one or more supporting bars extending along a length of the support member and attached to a bottom portion of the support member, wherein the bars are substantially parallel to each other and are capable of movement along the vertical direction concomitantly with a vertical movement of the support member;

a generally vertical frame structure for receiving the vertical support member, wherein the frame structure further comprises;

a first stationary support bar attached to a top portion of the frame structure and extending along the length of the frame structure, wherein the first stationary support bar comprises a groove for receiving the front edge or the back edge of the planar tabletop, wherein the first stationary support bar is substantially parallel to the one or more supporting bars of the vertical support member, wherein the first stationary support bar is parallel to the tabletop when the tabletop is horizontal at a 0° angle and is perpendicular to the tabletop when the tabletop is vertical at a 90° angle; and a second stationary support bar attached to a bottom portion of the frame structure, wherein the second stationary support bar is substantially parallel to the first stationary support bar and to the one or more supporting bars of the vertical support member; and two or more wheels for ease of movement of the work surface, wherein the wheel are attached directly to the frame structure or may be attached to a rod or a similar device welded onto or attached to the frame structure.

2. The work surface of claim 1, wherein the tabletop comprises a white board, an easel, a project table, a partition board, or combinations and modifications thereof.

3. The work surface of claim 1, wherein the first stationary support bar is a top edge of a planar surface.

4. The work surface of claim 3, wherein the planar surface enables functioning of the work surface as a partition.

5. The work surface of claim 3, wherein the planar surface comprises a material similar to the planar tabletop.

6. The work surface of claim 1, wherein the ridge or the groove in the first stationary support bar locks the tabletop at a 90° angle.

7. The work surface of claim 1, further comprising a wheel locking mechanism for preventing movement of the work surface during use.

8. The work surface of claim 1, further comprising a mechanism for removing the wheels once the work surface is placed at a desired location.

9. The work surface of claim 1, wherein the work surface is used as a project table when the tabletop is substantially horizontal or at a 0° angle.

10. The work surface of claim 1, wherein the work surface is used as white board or an easel when the tabletop is adjusted at an angle between 45° and 90°.

11. The work surface of claim 1, wherein the work surface is used as a partitioning device or partition board when the work surface is substantially vertical or at a 90° angle.

12. The work surface of claim 1, wherein the drive system is a pneumatic, spring, electric or hydraulic drive system.

13. A transforming all-in-one powered system comprising a project table, a white erase board, and an office partition device capable of movement along a vertical axis, capable of a 360-degree rotation around a pivot or both comprising:

a generally planar tabletop defining a plane, wherein the table top comprises a work (top) surface, a bottom surface, a front edge, a back edge, a left edge, and a right edge;

a generally vertical support member disposed for a movement in a generally vertical direction, wherein a top portion of the vertical support member is attached to the right edge and the left edge of the tabletop by one or more pivot joints, wherein the vertical support member further comprises one or more supporting bars extending along a length of the support member and attached to a bottom portion of the support member, wherein the bars are substantially parallel to each other and are capable of movement along the vertical direction concomitantly with a vertical movement of the support member;

a generally vertical frame structure for receiving the vertical support member, wherein the frame structure further comprises;

a first stationary support bar attached to a top portion of the frame structure and extending along the length of the frame structure, wherein the first stationary support bar comprises a groove for receiving the front edge or the back edge of the planar tabletop, wherein the first stationary support bar is substantially parallel to the one or more supporting bars of the vertical support member, wherein the first stationary support bar is parallel to the tabletop when the tabletop is horizontal at a 0° angle and is perpendicular to the tabletop when the tabletop is vertical at a 90° angle; and a second stationary support bar attached to a bottom portion of the frame structure, wherein the second stationary support bar is substantially parallel to the first stationary support bar and to the one or more supporting bars of the vertical support member; and two or more wheels for ease of movement of the work surface, wherein the wheel are attached directly to the frame structure or may be attached to a rod or a similar device welded onto or attached to the frame structure.

14. The system of claim 13, wherein the ridge or the groove in the first stationary support bar locks the tabletop at a 90° angle.

15. The system of claim 13, wherein the first stationary support bar is a top edge of a planar surface.

16. The system of claim 15, wherein the planar surface enables functioning of the system surface as a partition.

17. The system of claim 15, wherein the planar surface comprises a material similar to the planar tabletop.

18. The system of claim 13, further comprising a wheel locking mechanism for preventing movement of the system during use.

19. The system of claim 13, wherein the system is used as a project table when the tabletop is substantially horizontal or at a 0° angle.

20. The system of claim 13, wherein the system is used as white board or an easel when the tabletop is adjusted at an angle between 45° and 90°.

21. The system of claim 13, wherein the system is used as a partitioning device or partition board when the work surface is substantially vertical or at a 90° angle.

22. The system of claim 13, wherein the drive system is a pneumatic, spring, electric or hydraulic drive system.

23. A method of transforming an open space, dividing a large area into one or more smaller areas or both comprising the steps of:

providing an open space, a large area or both;

providing one or more drive operated partitioning devices capable of movement along a vertical axis, capable of a 360-degree rotation around a pivot or both comprising:

a generally planar tabletop defining a plane, wherein the table top comprises a work (top) surface, a bottom surface, a front edge, a back edge, a left edge, and a right edge;

a generally vertical support member disposed for a movement in a generally vertical direction, wherein a top portion of the vertical support member is attached to the right edge and the left edge of the tabletop by one or more pivot joints, wherein the vertical support member further comprises one or more supporting bars extending along a length of the support member and attached to a bottom portion of the support member, wherein the bars are substantially parallel to each other and are capable of movement along the vertical direction concomitantly with a vertical movement of the support member;

a generally vertical frame structure for receiving the vertical support member, wherein the frame structure further comprises;

a first stationary support bar attached to a top portion of the frame structure and extending along the length of the frame structure, wherein the first stationary support bar comprises a groove for receiving the front edge or the back edge of the planar tabletop, wherein the first stationary support bar is substantially parallel to the one or more supporting bars of the vertical support member, wherein the first stationary support bar is parallel to the tabletop when the tabletop is horizontal at a 0° angle and is perpendicular to the tabletop when the tabletop is vertical at a 90° angle; and a second stationary support bar attached to a bottom portion of the frame structure, wherein the second stationary support bar is substantially parallel to the first stationary support bar and to the one or more supporting bars of the vertical support member; and two or more wheels for ease of movement of the work surface, wherein the wheel are attached directly to the frame structure or may be attached to a rod or a similar device welded onto or attached to the frame structure; and placing the one or more partitioning devices with the planar tabletop in a vertical orientation in the open space or the large area to transform or divide the open space or the large area, wherein the one or more partitioning devices may be linked to each other or to existing structures in the open space or the large area by one or more connectors.

24. The method of claim 23, wherein the open space or the large area comprises an office space, a laboratory, a warehouse, a classroom, a conference room, an arena and any combinations thereof.

25. The method of claim 24, wherein the partitioning device transforms an office space into one or more cubicles, training rooms, conference rooms, and any combinations thereof.

26. The method of claim 23, wherein the connectors comprise ropes, chains, tethers, and any combinations thereof.

27. The method of claim 23, further comprising a wheel locking mechanism for preventing movement of the partitioning device.

28. The method of claim 23, wherein the ridge or the groove in the first stationary support bar locks the tabletop at a 90° angle.

29. The method of claim 23, wherein the first stationary support bar is a top edge of a planar surface.

30. The method of claim 29, wherein the planar surface enables functioning of the partitioning device to transform the open space, divide the large area into one or more smaller areas or both.

31. The method of claim 29, wherein the planar surface comprises a material similar to the planar tabletop.

32. The method of claim 23, wherein the tabletop comprises a white board, an easel, a project table, a partition board, or combinations and modifications thereof.

33. The method of claim 23, wherein the partitioning device may be used as the project table, the white board, or the easel in the open space or the large area.

34. The method of claim 23, wherein the partitioning device is used as a project table when the tabletop is substantially horizontal or at a 0° angle.

35. The method of claim 23, wherein the partitioning device is used as white board or an easel when the tabletop is adjusted at an angle between 45° and 90°.

36. The method of claim 23, wherein the drive system is a pneumatic, spring, electric or hydraulic drive system.

37. An office space or a large area transformed or partitioned into one or more small areas or cubicles by the method of claim 23.

* * * * *